US009681723B2

(12) United States Patent
Bursey

(10) Patent No.: US 9,681,723 B2
(45) Date of Patent: Jun. 20, 2017

(54) PORTABLE HAIR STYLING DEVICE WITH USB CONNECTION TO POWER SOURCE

(71) Applicant: Porsha Bursey, Red Oak, TX (US)

(72) Inventor: Porsha Bursey, Red Oak, TX (US)

(73) Assignee: Porsha Bursey, Red Oak, TX (US)

( * ) Notice: Subject to any disclaimer, the term of this patent is extended or adjusted under 35 U.S.C. 154(b) by 0 days.

(21) Appl. No.: 14/682,652

(22) Filed: Apr. 9, 2015

(65) Prior Publication Data

US 2016/0295985 A1 Oct. 13, 2016

(51) Int. Cl.
*H05B 1/02* (2006.01)
*A45D 1/04* (2006.01)
*A45D 1/28* (2006.01)

(52) U.S. Cl.
CPC ..... *A45D 1/04* (2013.01); *A45D 1/28* (2013.01); *A45D 2001/045* (2013.01)

(58) Field of Classification Search
CPC ..... A45D 1/04; A45D 2001/045; H05B 1/02; H05B 1/0252; H05B 3/0071
USPC ..... 219/222, 225, 227, 231, 240, 494, 497, 219/506
See application file for complete search history.

(56) References Cited

U.S. PATENT DOCUMENTS 8,967,159 B1 * 3/2015 Jenkins ..... A45D 2/001 132/223
2006/0201527 A1 * 9/2006 Higgins ..... A45D 1/04 132/225
2015/0201726 A1 * 7/2015 Prats ..... A45D 1/04 219/225

* cited by examiner

*Primary Examiner* — Mark Paschall
(74) *Attorney, Agent, or Firm* — Darcell Walker

(57) ABSTRACT

A portable curling iron used to style hair enables a user to style hair without the need to plug in the curling iron to a conventional electrical outlet. The present invention provides sufficient heat the curling iron in order to adequately style hair. The power for portable use of a device of the present invention has a power supply means that provides enough power to adequately heat the curling iron for effective hair styling from a power source such as found in a motor vehicle. Connection to the power source can be via a USB connection.

11 Claims, 6 Drawing Sheets

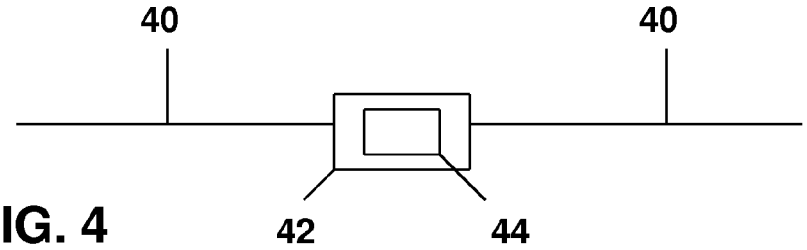
FIG. 4
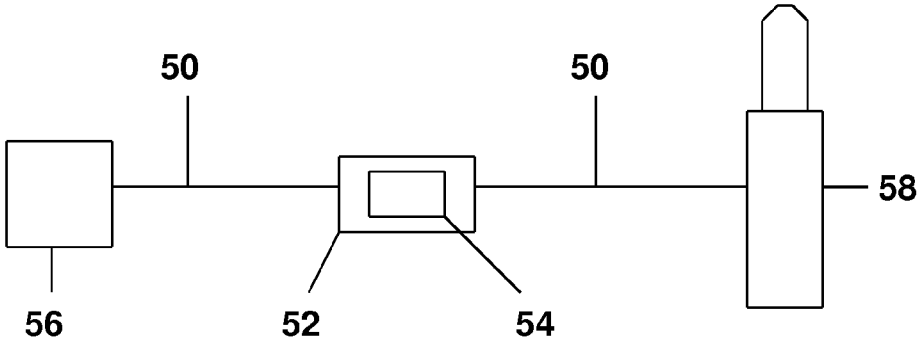
FIG. 5
| Time | Power In | Power Out | Current Power |
|---|---|---|---|
| 0 | 0v | 0v | 15v |
| 1 min. | 3v | 5v | 13v |
| 2 min. | 3v | 5v | 11v |
| 3 min. | 3v | 5v | 9v |
| 4 min. | 3v | 5v | 7v |
| 5 min. | 3v | 5v | 5v |
| 6 min. | 3v | 5v | 3v |
| 7 min. | 3v | 5v | 1v |
FIG. 6

PORTABLE HAIR STYLING DEVICE WITH USB CONNECTION TO POWER SOURCE

CROSS-REFERENCE TO RELATED APPLICATION

This formal utility patent application is related to provisional patent application No. 61/977,270 filed on Apr. 9, 2014. The contents of both applications are incorporated herein by reference.

FIELD OF THE INVENTION

This invention relates to an improved hair styling device for use in a variety of power source outlets. In particular, this invention relates to a hair styling device that can receive power from a power source through a USB connector. More particular, this invention relates to a system for supplying power to a hair styling device through a power system that comprises a power storage device and a direct power source. Still the present invention relates to a hair styling device having the capability to be used in a motor vehicle using the power supplied through a power storage device connected to a constant power source of the motor vehicle.

BACKGROUND OF THE INVENTION

Using heat to straighten hair has been a part of hair styling since the 1800s. The challenge was to determine the best way to accomplish this feat. Initially, irons designed to iron clothes were used by women on their hair. This approach often resulted in damaged hair from the intense heat. Heated rods were also used to straighten her hair. Eventually, these obstacles were overcome.

The application of heat is the key to effectively styling hair. Hydrogen bonds in each strand of hair cause the hair to curl. After sufficient heat is applied to the hair strand, the hydrogen bonds are broken and the hair lies straight. The more curl in the hair, the more heat is required to break up these bonds so the hair can lie flat.

One approach to applying heat to hair was the idea of hinging two flat plates together. In 1909, Isaac K. Shero received a patent for a hair-straightening device, which was comprised of two flat irons that were heated and pressed together. This product was the first known "flat iron". But with any industry there is evolution, a desire to make a current product better. Today, many flat irons have a hinged design.

As mentioned, heat is a key element in the operation of a flat iron product. Today the most effective flat irons have ceramic heating elements. The ceramic coating on these irons is much more effective due to the ability to provide constant heat while styling. Their heat up time has been reduced to about 10 seconds.

Although there are numerous hair styling products that address various aspects of actually styling hair, little attention has been given to alternative ways of powering the hair styling devices. One explanation for the lack of attention given to powering a hair styling device is that there are few options for powering these devices. A hair styling device requires an enormous amount of heat. The primary way to supply this heat is through connecting the hair styling device to a power source. This power source is usually an outlet in a building structure. For example, batteries do not have enough power to provide the amount of heat required to adequately heat a curling iron for a sufficient amount of time.

Historically there have been three ways to power a curling iron product. One way is to directly connect the device to an AC line in a building structure. A second way incorporates a heat-storing body, which keeps heat after heating. A third way is with a rechargeable battery. The AC line type hair iron cannot be used without an AC line and lacks portability. The heat-storing device type hair iron can be used only for a short time after disconnection from the AC line, and therefore lacks portability. Similar to the heat-storing device, a battery cannot hold a sufficient amount of charge and has to be frequently recharged.

Throughout the years, there have been several modifications to hair styling devices, although few have addressed the issue of powering the hair styling device. U.S. Pat. No. 4,354,092 to Manabe et al. describes an electrically heated hair curling iron that includes a sheet-shaped heater with electrodes affixed to an electrically resistive layer, wrapped around an elongated cylindrical support, and capable of being rapidly heated and maintained hot by electric current available from a rechargeable storage battery. The resistive layer has a positive temperature coefficient of resistance so that its temperature is self-limiting. The storage battery is contained in a handle attached to the cylindrical support, and a battery charger is disclosed which comes into electrical contact with the battery when the handle is inserted in a cavity located in the battery charger. An elongated longitudinal clip is used to retain the hair in contact with the heater; a removable cap protects the heater and clip when the iron is not in use, and also engages a switch, which ensures that the iron does not remain on. The charger and the curling iron are each provided with an LED to indicate operation of the charger and state of charge of the battery, respectively. This particular approach requires removing the battery from the hair styling device and recharging the device.

The inability to supply sufficient power except through the AC source limits the portability of the device. For example, a passenger in a motor vehicle cannot use a curling iron device because the amount of power supplied through the vehicle power outlet is in sufficient to adequately heat the curling iron. In addition, an attempt to supply sufficient power and heat to the curling iron can be risky and could cause damage to the power system of the motor vehicle.

As mentioned, primary way of using a curling iron product to style hair requires the direct connection to an AC power outlet. Portable use of a curling iron would require some type of power storage system in the curling iron. The use of a battery to supply sufficient power to the curling iron product to produce enough heat to adequately style someone's hair would require a battery of an unreasonable size for this type of product. There remains a need for a device and system for supplying power to a hair styling device such as a curling iron such that such a hair styling can be used in a variety of places and not be dependent on AC outlet power source for power.

SUMMARY OF THE INVENTION

This invention describes a portable curling iron used to style hair. The curling iron of the present invention is a portable device that enables a user to style hair without the need to plug in the curling iron to an electrical outlet. The present invention provides sufficient heat the curling iron in order to adequately style hair. The power for portable use of a device of the present invention can incorporate a combination of a power storage unit and indirect power from an external power source.

One embodiment of the present invention enables the user to use this curling iron in motor vehicle. This embodiment incorporates features that provide sufficient heat for the curling iron. This ability to adequately heat the curling iron in a motor vehicle is a key advancement in that a motor vehicle cannot provide sufficient power to adequately heat a conventional curling iron. However, this embodiment of the present invention uses a combination power source that includes power supplied by the motor in a manner similar to power supplied by a vehicle to other devices. In addition to the power supplied by the motor vehicle, this embodiment of the present invention incorporates a pre-charged power storage element that also provides power to the curling iron. The combination of the motor vehicle power and power from the power storage element provides enough power to sufficiently heat the curling iron. This portable curling iron of the present invention can have a USB connector that enables to user to plug the iron into an electrical power source that may be located in a motor vehicle.

One key aspect of the portability of the present invention is that one can use this device in locations other than fixed building structures such as homes, hotels rooms and public restrooms. As mentioned, a primary use of the present invention can be in motor vehicles.

DESCRIPTION OF THE DRAWINGS

FIG. 4 is a view of power device configuration for the present invention.

FIG. 5 is a view of the system of the present invention for powering a hair styling device.

FIG. 6 is a chart showing power storage levels for the power storage element used to supply power in an embodiment of the present invention.

DESCRIPTION OF THE INVENTION

Figure 1:
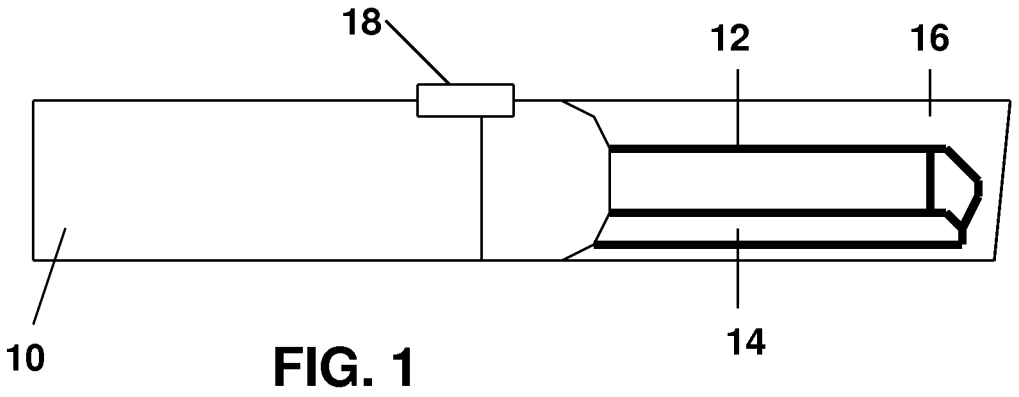
FIG. 1 is a view of a conventional curling iron hair styling device.

Hair styling devices such as curling irons or flat irons require a substantial amount of heat to adequately operate. In conventional uses, the hair styling device is used in a building and is connected to an AC power supply. As mentioned, attempts to design portable hair styling devices such as curling irons have not produced adequate means to sufficient power these devices. Referring to FIG. 1, a conventional hair styling device such as a curling iron comprises the curling elements 12 and 14. Included but not shown is a heating element that receives from a power source supply through the handle 10. A cap 16 covers the curling elements 12 and 14. A button 18 controls the operations of the device.

Figure 2:
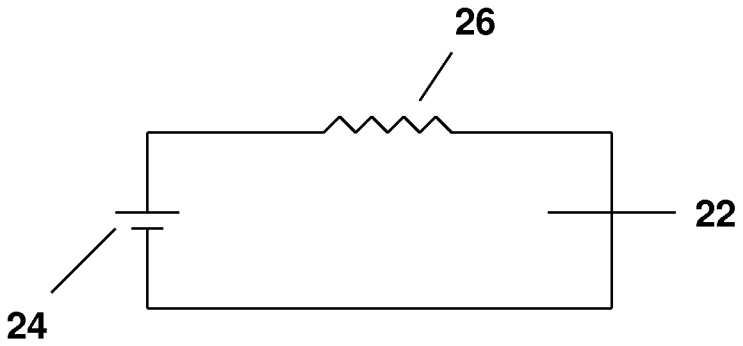
FIG. 2 is a schematic view of a conventional electronic circuit.
Figure 3:
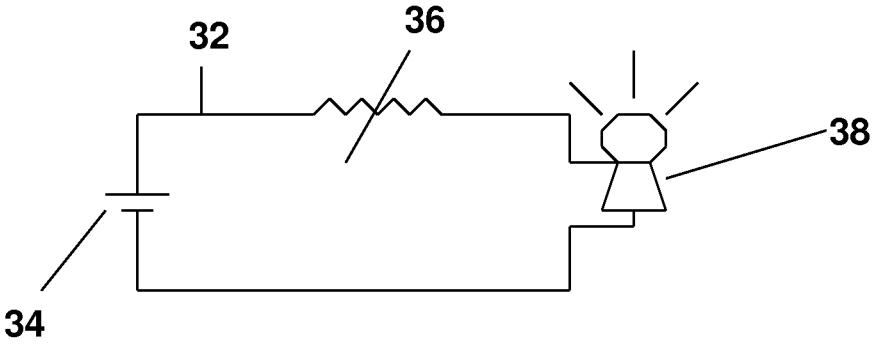
FIG. 3 is a schematic view of a conventional electronic circuit powering a load.

Electronic devices operate based on the concept illustrated in the schematic in FIG. 2. In the conventional electronic circuit 22, there is a power source 24 that supplies a voltage to the circuit. An electrical current flows from the power supply through the circuit and a resister 26 connected the power source. The electrical current flowing through the circuit is determined by the amount of the voltage from the power source 24 and the size of the resister 26. FIG. 3 shows a schematic of an electronic circuit 32 powering a load 38. Again in this circuit 32, there is a power source 34 and a variable resistor 36. The variable resister 36 enables the user to change the amount of resistance in the resistor. The ability to change resistance in the circuit enables one to change the amount of current flowing through the circuit. In the present invention, the curling iron hairstyle device represents the load. The current from the power source flows through the circuit and powers up the load 38. The ability to adjust the resistance determines the amount of power the load will receive.

One desired use for curling iron hair styling devices is the use of these devices in a motor vehicle. In some instances, a passenger while the vehicle is moving or a driver when the vehicle is parked may desire to use a hair styling device to 'touch up' their hairstyle. The power supplied by a motor vehicle is generally inadequate to sufficiently heat the iron to satisfactorily style the user's hair. Common car adapters that plug into the electrical outlet in the vehicle through which electrical devices such as DVD players are powered cannot safely supply the requisite amount of power to operate the curling iron hair styling device.

The present invention provides a system that will enable a user to receive sufficient power to adequately and safely operate a curling iron hair styling device in a motor vehicle. Referring to FIG. 4, this system of the present invention comprises an adapter 42 that connects to both a power source and the curling iron device. Wires 40 can connect the adapter 42 to both the power source and the curling iron device. Within the adapter 42 is a storage element 44 that has the capability to receive, store and disseminate power in the form electricity. FIG. 5 shows the system of the present invention having the power source 56, the adapter 52 containing the power storage element 54 and the curling iron 58. Connectors 50 connect the power source, adapter and curling iron.

In the implementation of the present invention, the power storage element 54 inside the adapter 52 as mentioned has the capability to store, receive and disseminate electricity to a device. In the implementation of the present invention, one can charge the storage element 54 with an initial amount of charge. For example, the storage element may be initially charged with 15 volts of electricity. At this point, when the adapter is connected to the curling iron, the curling iron can be initially powered. However, the electrical charge stored in this power storage element will not sustain use of the curling iron but for short period of time. In the present invention, the power source 56 supplies electricity to the power storage element 54 while electricity from the power storage element is being supplied to the curling iron device 58. In actuality, the amount of the power be dissipated from the power storage element 54 will probably be greater than the amount of power being supplied to the power storage device from the power source.

FIG. 6 shows a chart of the power levels for the power storage element 54 during use of the device of the present invention as a portable curling iron. As illustrated, the power storage element 15 can be pre-charged to hold 15 volts of charge. As a result, the current power of the power storage element at time zero is 15 volts. A curling iron device may use approximately 5 volts per minute to supply sufficient to the curling iron. In addition, the power storage device can be charged at approximately 3 volts per minute. When the process begins, after 1 minute of use, the current charge remaining in the power storage device will be 13 volts. The power storage element 54 dissipated 5 volts and received 3 volts from an external power source resulting in a net use of two volts. At this rate each minute of use of the curling iron device will result in a decrease of 2 volts. FIG. 6 shows the power storage element 54 will be able to supply adequate power to the portable curling iron for approximately 6 to 7 minutes.

As illustrated in the chart in FIG. 6, the user will still have only a limited amount of time to use the curling iron before the power storage element will not be able to supply power to adequate heat the curling iron. However, the system of the present invention will enable the user to use the curling iron device for an extended period of time beyond the current capabilities of batteries and other storage devices. In addition, applications such as use in a motor vehicle are primarily for 'touch ups', which are only short periods of time. For these types of applications, the amount of period supplied by the power storage element should be sufficient. In addition, the amount of the initial charge stored in the power storage element and the amount of power used by the curling iron influence the length of time one can use the system of the present invention. As mentioned, a user can adjust the amount of power used by the hair styling device (curling iron).

Figure 7:
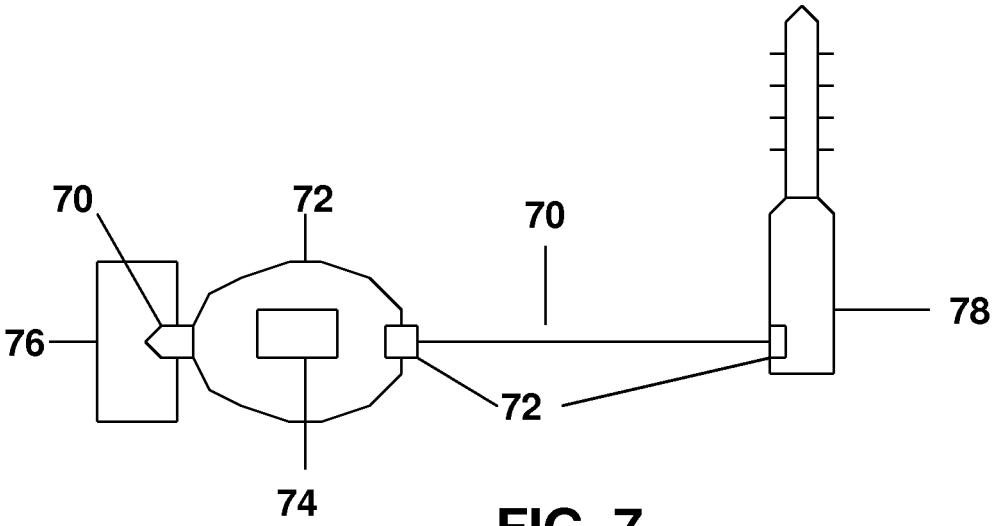
FIG. 7 is a view of the system of the present invention for powering a hair styling device incorporating USB ports and USB connectors for connecting the system components.

The present invention incorporates a USB connector to connect the curling iron and the adapter. FIG. 7 illustrates the connection of the power source 76, the adapter 72 and the curling iron 78. A USB connector 74 is incorporated. As shown, the adapter 72 can have conventional male connector 70 that is inserted into the power source 76 in a motor vehicle. A conventional connector in a motor vehicle can be the cigarette lighter port or a dedicated power outlet. However, many motor vehicles today have USB connection ports for connecting devices inside the vehicle. The adapter 76 can be connected to the curling iron 78 via a cord 60 and connectors and ports 72.

Figure 8:
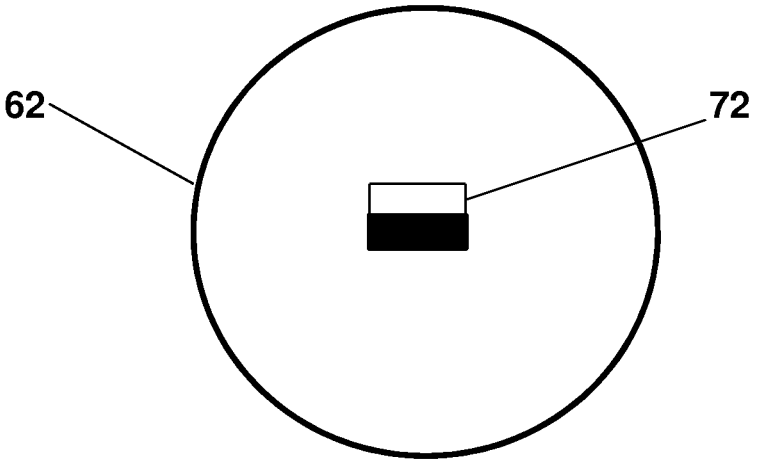
FIG. 8 is a front view of an USB plug for use in the present invention.
Figure 9:
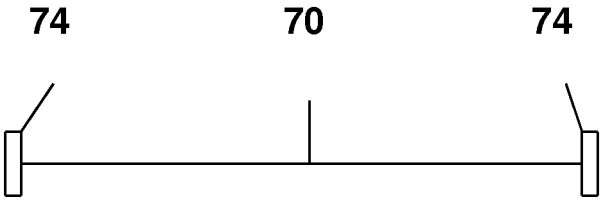
FIG. 9 is a USB connect cord with USB connectors on each end.

FIG. 8 shows an adapter 72 having a USB port 74. The adapter 72 can also have a USB lead for insertion into a USB port. FIG. 8 shows a cord 60 having USB leads 74 attached to end of the cord. These connectors facilitate use of the system of the present invention in motor vehicles with USB connection capabilities.

Figure 10:
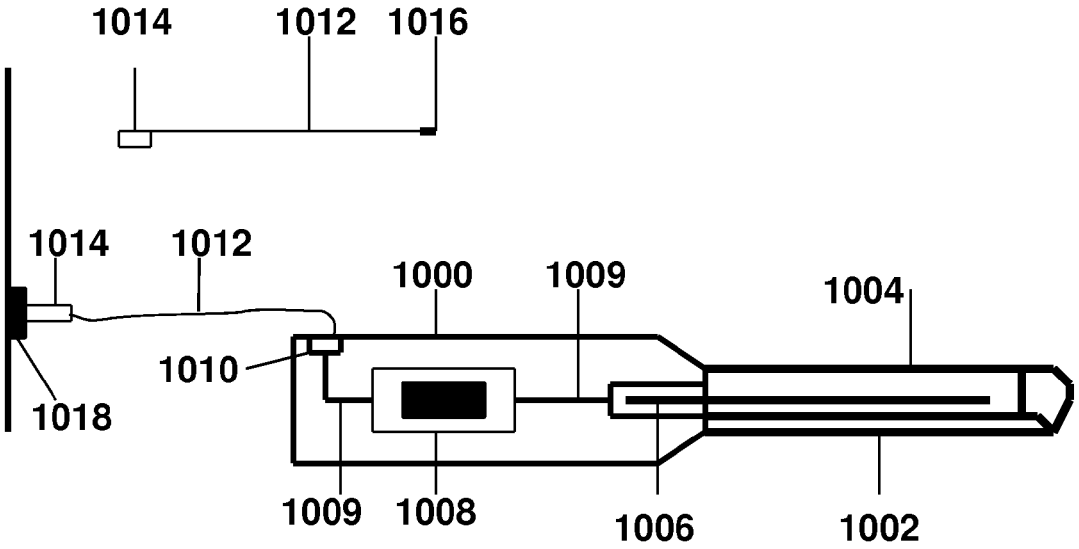
FIG. 10 shows a schematic view of the operations of an embodiment of the portable curling iron of the present invention.

As mentioned, the present invention has the capability to operate in a conventional mode or in a portable mode. FIG. 10 shows a schematic view of the operations of an embodiment of the portable curling iron of the present invention. The curling iron product comprises the handle 1000 for controlling the curling iron during use. The curling elements attach to the handle and comprise a clamp 1002 and a curling rod element 1004 which is used to heat one's hair during styling. The clamp and curling rod attach to the handle 1000 and can be conventional curling elements. A heating element 1006 within the handle extends through the curling rod and receives power and converts this power into heat for the curling rod. A power storage element 1008 is a source of power for heating element 1006. A typical power storage element can be some form of battery. However, this power storage element must have the capacity to hold and supply enough power to adequately heat the curling rod. Internal wiring 1009 provides the electrical connection between the power storage element and the heating element. Wiring 1009 also connects the power storage element USB connector port 1010 in the curling iron. The power cord 1012 connects to the curling iron via the USB connector port 1010 and to the USB power plug 1014 for supplying electrical power from an external power source. A USB connector 1016 at the end of the power cord 1012 connects the power cord to the curling iron via USB port 1010. The USB plug 1014 connects to the power outlet 1018. For example, this power outlet 1018 can be a typical power source outlet found in a motor vehicle that is used to power other electrical devices such as DVD players. As shown, the handle 1000 contains various components, including 1006, 1008, 1009, and 1010, to power and supply heat. Although not shown, the curling iron also has a temperature gauge to prevent the iron from becoming too hot.

Figure 11:
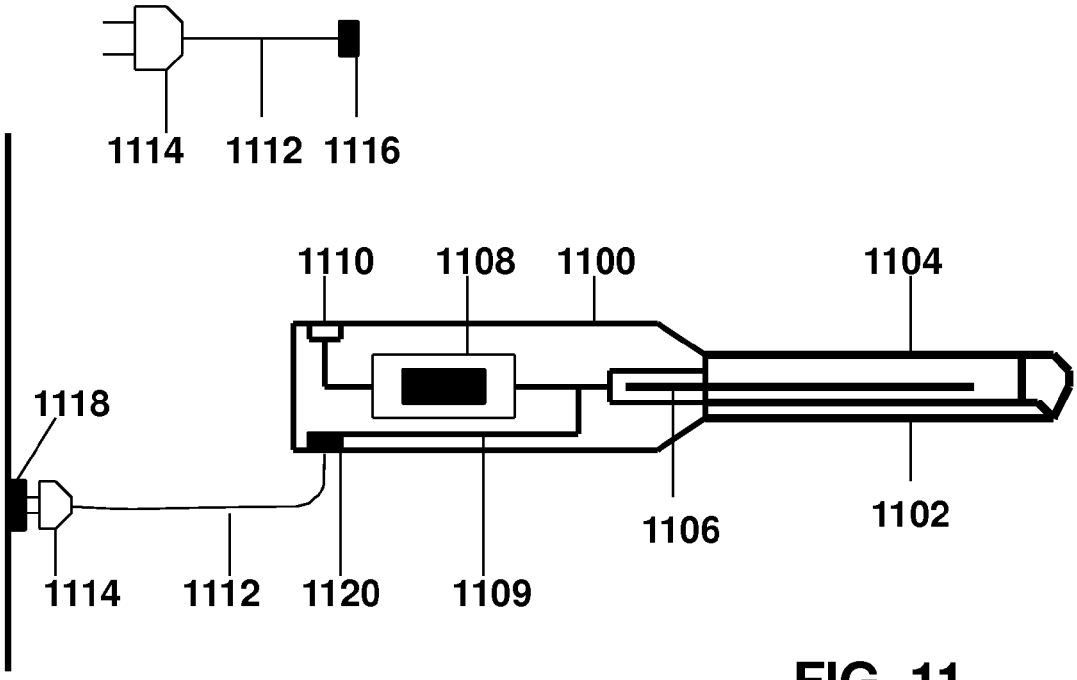
FIG. 11 shows a schematic view of the operations of an alternate embodiment of the portable curling iron of the present invention showing the capability to use the curling iron as a portable device or as a conventional device.

The present invention can have the capability to function as a portable curling iron or a conventional curling iron. Referring to FIG. 11, shown is a schematic view of the operations of an alternate embodiment of the portable curling iron of the present invention showing the capability to use the curling iron as a portable device or as a conventional device. Elements 1100, 1102, 1104, 1106, 1108, 1110, 1112, 1114, and 1118 refer to corresponding elements shown in FIG. 10. The embodiment of the present invention shown in FIG. 11 has a connector 1120 through which electrical current is provide directly to the heating element 1106. This power from plug 1118 is the standard AC power source.

In the present invention, when the user desires to use the hair styling device in a conventional manor at one's home or in some other building, power can be supplied to the hair styling device using the standard AC power source. The device of the present invention can have a connector for the standard AC power source and a USB connector for applications described herein.

Figure 12:
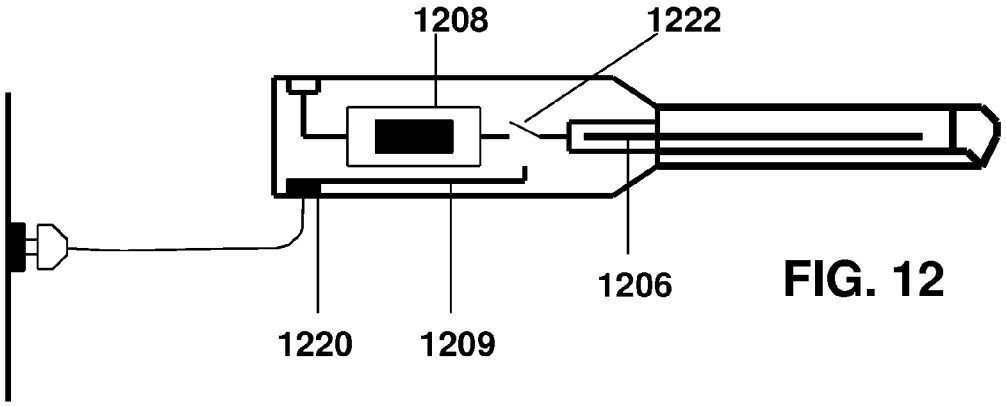
FIG. 12 shows a schematic view of the operations of an embodiment of the portable curling iron of the present invention incorporating a three position switch for directing power to the heating element.
Figure 13:
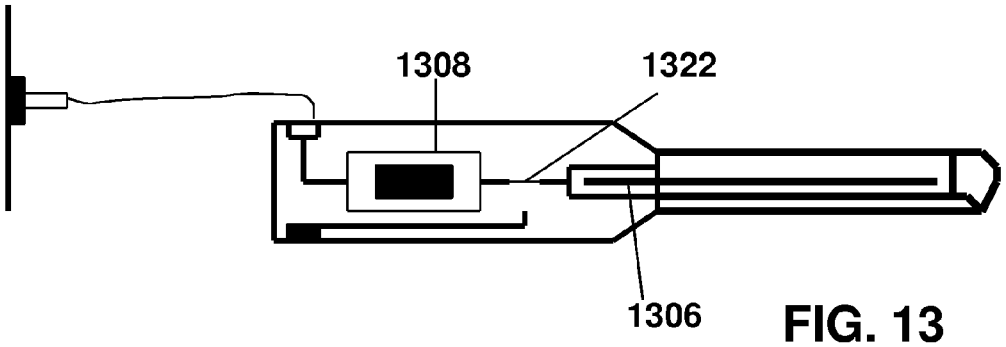
FIG. 13 shows a schematic view of the operations of an embodiment of the portable curling iron of the present invention in which the three position switch directs power to the heating element from the power storage element.
Figure 14:
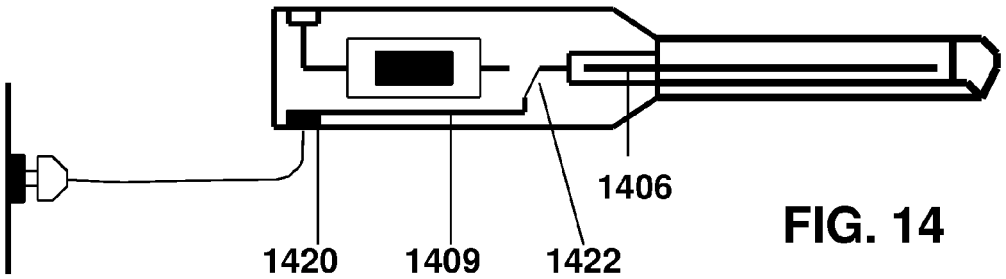
FIG. 14 shows a schematic view of the operations of an embodiment of the portable curling iron of the present invention in which the three position switch directs power to the heating element directly from a conventional AC power outlet.

When the curling iron of the present has the capability to be used both as a portable device (away from a conventional building structure) or as a conventional device, there must be a means to change the use mode of the device as desired. One embodiment in which this mode change can be facilitated is with a 3-position switch. FIGS. 12, 13 and 14 show different switch positions for mode operations of the curling iron. FIG. 12 shows a schematic view of the operations of an embodiment of the portable curling iron of the present invention incorporating a three position switch for directing power to the heating element. The heating element 1206 of the curling can receive power from the power storage unit 1208 or direct current from the power source via the connection 1220. With the direct power source connection power cord 1209 connects the power source to the switch 1222. The switch 1222 can be an open position as shown or can connect to one of the power sources 1208 or 1220.

FIG. 13 shows a schematic view of the operations of an embodiment of the portable curling iron of the present invention in which the three position switch directs power to the heating element from the power storage element. As shown, the switch 1322 connects to the power storage unit 1308. When this connection is established, current flows from the power storage unit to the heating element 1306.

FIG. 14 shows a schematic view of the operations of an embodiment of the portable curling iron of the present invention in which the three position switch directs power to the heating element directly from a conventional AC power outlet. As shown, power is supplied via the connector 1420 and cord 1409 to the heating element 1406.

Figure 15:
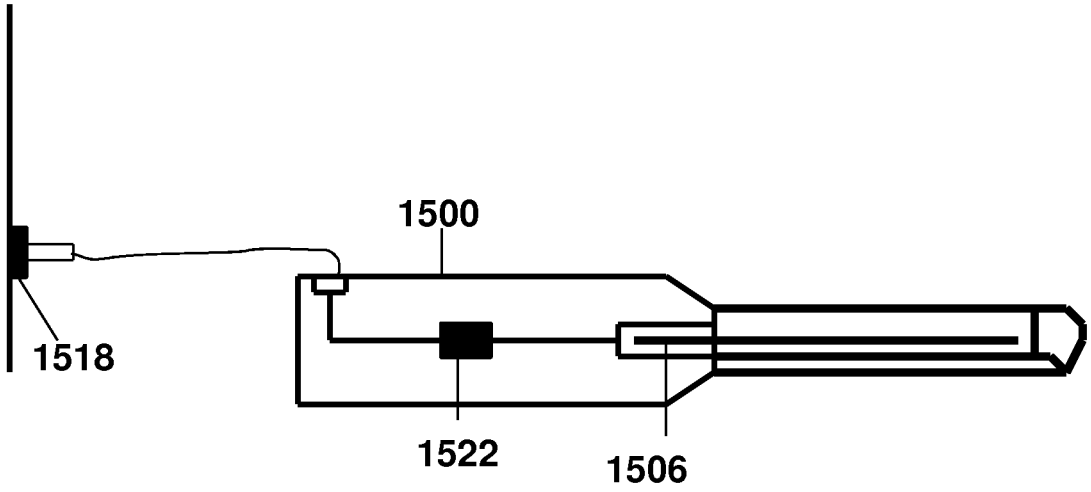
FIG. 15 shows a schematic view of the operations of an alternate embodiment of the portable curling iron of the present invention using a DC converter chip to facilitate adequate power for generating enough heat for the curling iron operations.

FIG. 15 shows a schematic view of the operations of an alternate embodiment of the portable curling iron of the present invention using a DC to DC converter chip to facilitate adequate power for generating enough heat for the curling iron operations. A DC-to-DC converter is an electronic circuit which converts a source of direct current (DC) from one voltage level to another. In this embodiment, the curling iron 1500 has an internal converter 1522 which takes in DC current and converts it to another voltage level and supplies the power to the heating element 1506. As shown, initial power from a portable power source 1518 such as a motor vehicle source flows into the curling iron and into the converter 1522. The raised voltage level from the converter enhances the power to the heating element.

While the present invention has been illustrated by the description of embodiments thereof, and while the embodiments have been described in some detail, it is not the intention of the applicant to restrict or in any way limit the scope of the invention to such details. Additional advantages and modifications will readily appear to those skilled in the art. The invention in its broader aspects is not limited to the specific details, representative apparatus and methods, and illustrative examples shown and described. Accordingly, departures may be made from such details without departing from the spirit or scope of the applicant's general inventive concept.

I claim:

1. A portable hair curling iron comprising:

a handle for manipulating a heated curling rod for styling hair;

an elongated curling rod for styling the hair, said curling rod being attached at one end of said handle;

an elongated heating element with said elongated curling rod for heating said curling iron, said elongated heating element electrically connected to a power source;

an elongated clamp element for clamping hair against said heated curling rod for styling hair, said clamp element pivotally attached to same end of said handle as said curling rod;

a power source housed in said handle for supplying power to heat said elongated heating element;

a USB connection means for connecting the portable curling iron to a portable power source;

a USB connection port on said handle for connecting the portable curling iron to a portable power source through said USB connection means and a dual electrical circuit for connecting the portable hair curling iron to an electrical source wherein:

a first circuit of the dual circuit comprises a first power receptacle in the portable hair curling iron for connecting the electrical storage element to a power source and a switch device for connecting said electrical storage element to said heating element;

a second circuit of the dual circuit comprises a second power receptacle in the portable hair curling iron for directly connecting an external power source to said switch device for connecting the external power source to said heating element.

2. The portable hair curling iron as described in claim 1 wherein said power source housed in said handle is a rechargeable battery.

3. The portable hair curling iron as described in claim 1 wherein said USB connection means is a power cord having a USB connector attached to each end of the power cord.

4. The portable hair curling iron as described in claim 2 further comprising an electrical connector to connect said power source to said heated curling rod.

5. The portable hair curling iron as described in claim 1 wherein said power source housed in said handle is DC to DC converter.

6. The portable hair curling iron as described in claim 1 further comprising an electrical connector to directly connect said heated curling rod to an external DC power source.

7. The portable hair curling iron as described in claim 6 further comprising a connection port on said handle for connecting the portable curling iron directly to the external DC power source.

8. The portable hair curling iron as described in claim 6 further comprising a switching mechanism to facilitate an electrical connection between said heated curling rod and said power source housed in said handle or a connection between said heated curling rod and an external DC power source.

9. The portable hair curling iron as described in claim 1 wherein said switch device further comprises a three position switch having one position contact to connect the electrical storage element to the heating element, a second position contact to directly connect the external power source to the heating element and a third open position.

10. A portable hair curling iron comprising:

a handle for manipulating a heated curling rod for styling hair;

an elongated curling rod for styling the hair, said curling rod being attached at one end of said handle;

an elongated heating element with said elongated curling rod for heating said curling iron, said elongated heating element electrically connected to a power source;

an elongated clamp element for clamping hair against said heated curling rod for styling hair, said clamp element pivotally attached to same end of said handle as said curling rod;

a power source housed in said handle for supplying power to heat said elongated heating element;

a USB connection means for connecting the portable curling iron to a portable power source;

a USB connection port on said handle for connecting the portable curling iron to a portable power source through said USB connection means;

a dual electrical circuit for connecting the portable hair curling iron to an electrical source wherein:

a first circuit of the dual circuit comprises a first USB port power receptacle in the portable hair curling iron for connecting the electrical storage element to a power source and a switch device for connecting said electrical storage element to said heating element;

a second circuit of the dual circuit comprises a second USB port power receptacle in the portable hair curling iron for directly connecting an external power source to said switch device for connecting the external power source to said heating element.

11. The portable hair curling iron as described in claim 10 wherein said switch device further comprises a three position switch having one position contact to connect the electrical storage element to the heating element, a second position contact to directly connect the external power source to the heating element and a third open position.

* * * * *